US009793620B2

(12) United States Patent
Marsh et al.

(10) Patent No.: US 9,793,620 B2
(45) Date of Patent: Oct. 17, 2017

(54) CONNECTOR ASSEMBLY WITH A BLADE CONNECTOR

(71) Applicants: Tyco Electronics UK Ltd, Wiltshire (GB); TE Connectivity Germany GmbH, Bensheim (DE)

(72) Inventors: John Marsh, London (GB); Markus Eckel, Burstadt (DE); Rudiger Meier, Neckargemund (DE); Harald Ulrich, Fischbachtal (DE); Holger Stange, Frankenthal (DE); Jochen Fertig, Bensheim (DE); Konstantin Zech, Leimen (DE)

(73) Assignees: TE Connectivity Germany GmbH, Bensheim (DE); Tyco Electronics UK Ltd, Swindon (GB)

( * ) Notice: Subject to any disclaimer, the term of this patent is extended or adjusted under 35 U.S.C. 154(b) by 0 days.

(21) Appl. No.: 15/253,300

(22) Filed: Aug. 31, 2016

(65) Prior Publication Data

US 2017/0062955 A1 Mar. 2, 2017

(30) Foreign Application Priority Data

Aug. 31, 2015 (DE) ..... 10 2015 216 632
Nov. 23, 2015 (EP) ..... 15195936

(51) Int. Cl.
*H01R 4/48* (2006.01)
*H01R 4/58* (2006.01)
(Continued)

(52) U.S. Cl.
CPC ..... *H01R 4/4809* (2013.01); *H01R 4/26* (2013.01); *H01R 4/58* (2013.01); *H01R 13/113* (2013.01);
(Continued)

(58) Field of Classification Search
CPC ..... H01R 4/26; H01R 4/58; H01R 4/4809; H01R 31/08
See application file for complete search history.

(56) References Cited

U.S. PATENT DOCUMENTS 2,997,685 A 8/1961 Anderson
5,399,098 A * 3/1995 Marshall ..... H01R 13/20 439/397
(Continued)

FOREIGN PATENT DOCUMENTS

CH 702863 A1 3/2010
DE 1665132 1/1971
(Continued)

OTHER PUBLICATIONS

German Office Action, dated May 27, 2016, 6 pages.
Abstract of DE3330984, dated Mar. 14, 1985, 1 page.
Abstract of DE102005043601, dated Mar. 22, 2007, 1 page.

*Primary Examiner* — Briggitte R Hammond
(74) *Attorney, Agent, or Firm* — Barley Snyder

(57) ABSTRACT

A connector assembly for electrically contacting a blade connector to a second connector The connector assembly includes a blade connector which has a contact surface plane that is electrically connected to the second connector in the mated state. In order to improve mechanical and electrical properties of the overall connector assembly and, in particular, of the blade connector, the assembly further includes a mounting cage in which the blade connector is captively held and which has at least one clamping device that presses the second connector onto the contact surface plane of the blade connector in the mated state.

15 Claims, 5 Drawing Sheets

(51) Int. Cl.

| | |
|---|---|
| ***H01R 4/26*** | (2006.01) |
| ***H01R 13/11*** | (2006.01) |
| ***H01R 13/187*** | (2006.01) |
| ***H01R 13/22*** | (2006.01) |
| ***H01R 13/50*** | (2006.01) |
| ***H01R 13/627*** | (2006.01) |

(52) U.S. Cl.
CPC ..... *H01R 13/187* (2013.01); *H01R 13/22* (2013.01); *H01R 13/50* (2013.01); *H01R 13/6275* (2013.01)

(56) References Cited

U.S. PATENT DOCUMENTS 5,588,884 A * 12/1996 Rudoy ..... H01R 31/02 439/787
5,911,605 A * 6/1999 Wooldridge ..... H01R 13/28 439/790
5,941,740 A * 8/1999 Neuer ..... H01R 13/113 439/852
6,264,509 B1 * 7/2001 Kwang ..... H01R 13/113 439/852
6,293,831 B1 * 9/2001 Yamatani ..... H01R 13/115 439/849
6,452,101 B1 9/2002 Haramaki et al.
7,241,180 B1 7/2007 Wolfgang et al.
7,581,972 B2 * 9/2009 Daamen ..... H01R 13/6315 439/249
7,766,706 B2 * 8/2010 Kawamura ..... H01R 13/112 439/833
7,789,720 B2 9/2010 Zinn
8,827,754 B2 * 9/2014 Lee ..... H01R 13/187 439/843
9,070,990 B2 * 6/2015 Flickinger ..... H01R 4/48
9,231,326 B2 1/2016 Goesmann et al.
2013/0012072 A1 * 1/2013 Costello ..... H01R 13/18 439/660

FOREIGN PATENT DOCUMENTS

DE 33 30 984 A1 3/1985
DE 10 2005 043 601 B4 3/2007

* cited by examiner

CONNECTOR ASSEMBLY WITH A BLADE CONNECTOR

CROSS-REFERENCE TO RELATED APPLICATIONS

This application claims the benefit of the filing date under 35 U.S.C. §119(a)-(d) of German Patent Application No.: 10 2015 216 632.5 filed Aug. 31, 2015 and European Application No.: 15 195 936.8, filed Nov. 23, 2015.

FIELD OF THE INVENTION

The invention relates to a connector assembly for electrically contacting a blade connector to a second connector.

BACKGROUND

Connector assemblies for blade connectors are well known in the technical field of electrical connectors. In general, blade connectors are either adapted for being inserted into a blade receptacle or for being connected to a second connector by a screw which protrudes through a through-hole of the blade connector. These well-known connection types are functional. However, these connection types have several drawbacks. For example, the connection with a blade receptacle lacks the ability to connect the blade connector to the second connector in a secure and well defined manner. The connection of two blade connectors via a screw might securely fix one connector to another, but the mating of the two connectors is laborious. A known way of connecting a blade connector with another electrical connector is, for example, shown in EP 1 730 818 A1, where a female connector is provided with a receptacle in which the blade connector is received between a plurality of contact springs and is secured by the spring force of these contact springs. However, the female connector has a complicated design.

SUMMARY

It is therefore an object of the invention to provide a connector assembly as mentioned above which overcomes these drawbacks and provides a safe and reliable connection between a blade connector and a second connector, which allows an easy mating, and which is easily and cost efficiently to produce.

A connector assembly for electrically contacting a blade connector to a second connector, constructed in accordance with the present invention, includes a blade connector having a contact surface plane, a second connector electrically connected to the blade connector in a mated state through the contact surface plane, and a mounting cage captively holding the blade connector and having at least one clamping device that presses the second connector onto the contact surface plane of the blade connector in the mated state.

According to a first advantageous improvement, the blade connector may comprise at least one guiding element which is arranged on the contact surface plane and which extends basically perpendicular to the longitudinal direction along a guiding direction. The at least one guiding element which basically extends perpendicular to the longitudinal direction, has several advantages. First, a second connector can be mated with the blade connector along the guiding direction and may, therefore, be guided along a defined path and towards a defined optimized position. Second, the orientation of the at least one guiding element perpendicular to the longitudinal direction may allow a positive locking between the blade connector and the second connector, at least in the longitudinal direction. The contact surface plane is preferably aligned parallel with the longitudinal direction and the guiding direction.

In order to provide a simple and advantageous guiding element, the at least one guiding element may protrude from the contact surface plane perpendicular to the longitudinal direction and the guiding direction. In particular, such guiding element may taper in a direction away from the contact surface plane.

A guiding element may, for example, have the overall shape of a rail or a rib which extends longitudinally along the guiding direction. In the alternative, the at least one guiding element may be formed as a groove in the contact surface plane. A guiding element which is shaped as a groove may also taper towards an inside of the blade connector away from the contact surface plane.

As another advantageous alternative, the at least one guiding element may be formed as a series of spot-like structures, such as bumps, cylinders, pyramids or cones, in particular, truncated pyramids or cones. In this case, the second connector is preferably provided with at least one complementary guiding element which is formed as a groove into which the series of spot-like structures may be inserted to interact with said groove as linear guiding mechanism.

The at least one guiding element may have an overall trapezoidal cross-sectional shape in a cross section perpendicular to the guiding direction. Alternatively, the at least one guiding element may have any other cross-sectional shape, in particular a shape which tapers in a direction perpendicular to the contact surface plane. For example, the at least one guiding element may have a cross-sectional shape of a hyperbola, a half circle, or a triangle. These cross-sectional shapes, in particular the trapezoidal cross-sectional shape, may facilitate centering of the at least one guiding element with the at least one complementary guiding element of the second connector.

The contact surface plane is preferably closed without through-holes. However, this does not exclude a blade connector with at least one through-hole.

Preferably, the contact surface plane is provided with two guiding elements which are spaced apart from each other along the longitudinal direction. The two guiding elements may also form the boundaries of the contact surface plane. The two guiding elements may support a second connector in a mated position. Further, the two guiding elements may improve the guiding of the second connector during mating and may also improve a positive locking between the blade connector and the second connector.

The contact surface plane may be provided with at least one contacting protrusion which protrudes away from the contact surface plane perpendicular to the longitudinal direction and preferably also to the guiding direction. The at least one contacting protrusion may be adapted for improving the electrical contact between the blade connector and the second connector. The at least one contacting protrusion may especially be adapted in shape, size, or material properties such as composition or stiffness to provide a desired electrical connection between the two connectors.

In order to provide a compact blade connector, the at least one contacting protrusion may be arranged between two guiding elements which are spaced apart from each other along the longitudinal direction. In case the at least one guiding element protrudes from the contact surface plane, the at least one contacting protrusion does not protrude further from the contact surface plane than the at least one guiding element. It should be noted that the at least one guiding element may represent a linear structural element, whereas the at least one contacting protrusion may represent a point-like structural element.

The at least one contacting protrusion may be elastically deflectable. The at least one elastically deflectable contacting protrusion may, in particular, be a leaf spring which extends away from the contact surface plane and is deflectable in a direction towards the contact surface plane. The elasticity of the at least one contacting protrusion can be chosen depending on the desired properties of the electrical connection which the at least one contacting protrusion shape provides. In a preferred embodiment, the blade connector comprises two guiding elements which are spaced apart from each other and which comprise a plurality of elastically deflectable contacting protrusions between them.

As an alternative, the at least one contacting protrusion may be formed as a solid structure. In particular, a solid contacting protrusion may have the shape of a pyramid. Examples for other advantageous shapes for a solid contacting protrusion are a bump, a pin, a half sphere, a cone, a truncated cone or a ripple. A solid contacting protrusion may in particular be monolithically formed with the blade connector.

A plurality of contacting protrusions may be monolithically integrated with a contacting plate which is positioned on and conductively connected to the contact surface plane. This improvement is especially beneficial if the at least one contacting protrusion is intended to be provided with electrical and/or other physical properties which differ from the ones of the material from which the blade connector is made. Further, manufacturing the blade connector and the at least one contacting protrusion may be facilitated if these elements can be manufactured separately from each other. For example, the material for the blade connector can be chosen with respect to mechanical stability, whereas the material for the contacting plate can be chosen with respect to the electrical conductivity, oxidation protection, and/or elasticity in the case that the at least one contacting protrusion is elastically deflectable.

At least one contacting plate may be welded, in particular, laser-welded onto the contact surface plane. This can assure a good mechanical and electrical connection between the at least one contacting plate and the blade connector.

It should be noted, that elastically deflectable contacting protrusions may also be formed integrally with the blade connector, for example, as stamp-punched parts.

The connector assembly according to the invention may further be improved in that, in the mated state, the at least one guiding element of the blade connector and the at least one complementary guiding element may be positively locked in the longitudinal direction. As a result, the reliability of the connection may be improved. Further, the connectors may be protected against unintended un-mating.

According to another advantageous improvement of the connector assembly, the contact surface plane of the blade connector may comprise at least one elastically deflectable contacting protrusion, in particular a leaf spring, and at least one non-deflectable spacer adapted to separate the second connector from the contact surface plane at a distance which is smaller than a protruding length of the at least one contacting protrusion. This arrangement may protect the at least one elastically deflectable contacting protrusion against over-deflection in the mated state and against being torn apart by the second connector during mating, especially when the second connector is moved along the guiding direction. Non-deflectable means being at least less elastic than the at least one elastically deflectable contacting protrusion.

If separation of the second connector from the contact surface plane is desired, then this can alternatively be achieved by dimensioning the at least one guiding element on the contact surface plane and the at least one complementary guiding element on the second connector such that these elements keep the second connector at a desired distance from the contact surface plane.

The assembly may further comprise a mounting cage in which the blade connector is captively held and which comprises at least one clamping device adapted to press the second connector onto the blade connector in the mated state. The mounting cage may surround at least the contact surface plane of the blade connector and protect the same against damage. The mounting cage may have at least one blade opening for the blade connector and at least one insertion opening for the second connector. Since the blade connector and the second connector each comprise at least one guiding element, which are formed complementary to each other, the at least one clamping device may press these guiding elements into each other, so that a secure positive locking at least along the longitudinal direction is achieved.

Further, the at least one clamping device may secure the connection between the blade connector and the second connector in the mated state by a frictional connection, at least between the at least one guiding element on the blade connector and the at least one complementary guiding element on the second connector parallel with the guiding direction.

The clamping device may be monolithically integrated with a wall section of the mounting cage to allow a simple and compact structure. Preferably, the whole mounting cage is formed as a stamp-bent part for this reason.

According to another advantageous improvement of the connector assembly, the mounting cage may comprise a receptacle for at least one clamping plate between the blade connector and the at least one clamping device in the mated state. This allows the second connector to be inserted into the mounting cage without the at least one clamping device pressing the second connector against the blade connector during insertion. After insertion of the second connector, a clamping plate can be inserted into the receptacle to transmit the pressure from the at least one clamping device onto the second connector. At least one clamping plate may be part of the connector assembly. The arrangement, as described, may result in a zero-insertion force connector. As a result, the arresting plate provides a secondary locking feature for the contact assembly.

A zero-insertion force connection with a secondary locking feature can also be achieved by other means than that of an arrangement with a receptacle and a clamping plate. For example, the clamping device may be adapted in a way that it can be activated only after the second connector has been inserted into the mounting cage. Preferably, the clamping device is formed as a bistable spring with one stable position in which it is deflected to an outside of the mounting cage and clears the second receiving section for a zero-insertion force insertion of the second connector. After insertion of the second connector, the spring can be pushed such that it snaps to the second stable position in which it presses the second connector against the blade connector. Such a bistable spring can easily be formed by a leaf spring which is connected to the mounting cage with its opposite ends.

In the following, the invention and its improvements are described in greater details using exemplary embodiments and with reference to the figures. As described above, the various features shown in the embodiments may be used independently of each other in specific applications.

BRIEF DESCRIPTION OF THE DRAWINGS

In the following figures, elements having the same function and/or the same structure will be referenced by the same reference signs.

In the drawings.

DETAILED DESCRIPTION OF THE EMBODIMENTS

To simplify matters, the single elements, such as the second connector and the mounting cage, are described with respect to the directions defined by the blade contact and are identical to the directions in the mated state.

In the following, a first advantageous embodiment of a blade connector 1 for a connector assembly according to the invention is described with respect to FIGS. 1 and 2. The blade connector 1 basically extends along a longitudinal direction L.

By way of example, the blade connector 1 is shown as a crimp connector with a crimp section 3. Instead of having a crimp section 3, the blade connector 1 may have any other section which is suitable for being connected with an electrical conductor (not shown). Alternatively, the blade connector may also form an end section of an electrical conductor, such as a bus bar or may be arranged on a compacted end section of a braided wire.

Figure 6:
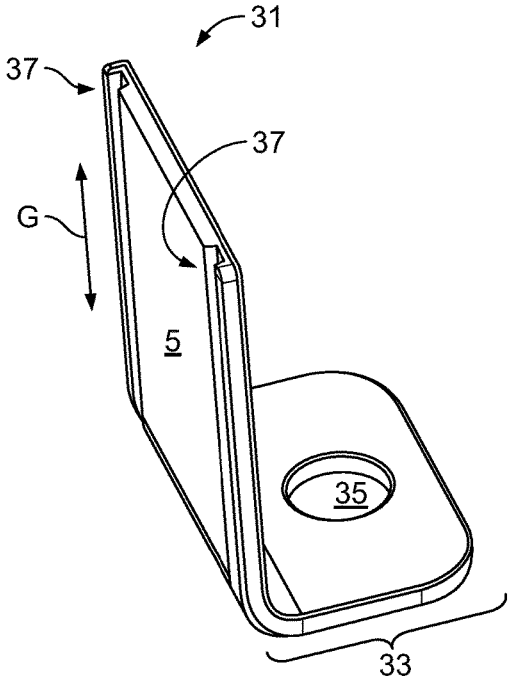
FIG. 6 shows a preferred embodiment of a second connector according to the invention in a perspective view.
Figure 7:
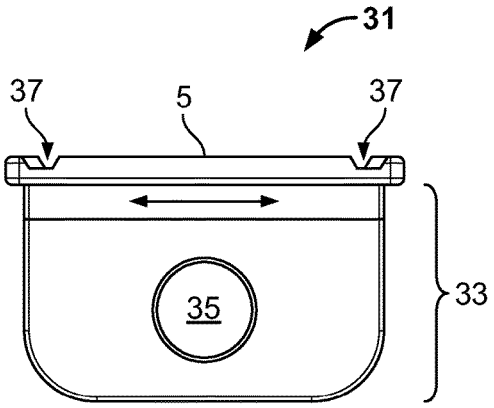
FIG. 7 shows the connector of FIG. 6 in a top view along the guiding direction.

The blade connector 1 comprises a contact surface plane 5 for being connected to a second connector 31 (a preferred embodiment of a second connector 31 is described below with respect to FIGS. 6 and 7). On the contact surface plane 5, the blade connector 1 comprises two guiding elements 7 which basically extend perpendicular to the longitudinal direction L along a guiding direction G. The guiding elements 7 are intended for guiding a second connector 31 during mating and for providing positive locking between two connectors 1 and 31 in the longitudinal direction L. It should be noted that, even if the blade connector 1 with guiding elements 7 forms an advantageous embodiment of a blade connector 1 according to the invention, embodiments without guiding elements 7 also are possible. The contact surface plane 5 basically extends parallel with the longitudinal direction L and with the guiding direction G.

The guiding elements 7 have an overall shape of a rib and protrude away from the contact surface plane 5 perpendicular to the guiding direction G. The guiding elements 7 taper in a direction away from the contact surface plane 5 and have overall trapezoidal cross-sectional shapes perpendicular to the guiding direction G. The guiding elements 7 are spaced apart from each other in the longitudinal direction L. It is clear for the person skilled in the art that the guiding elements 7 are parallel with each other, since both extend along the guiding direction G.

Figure 1:
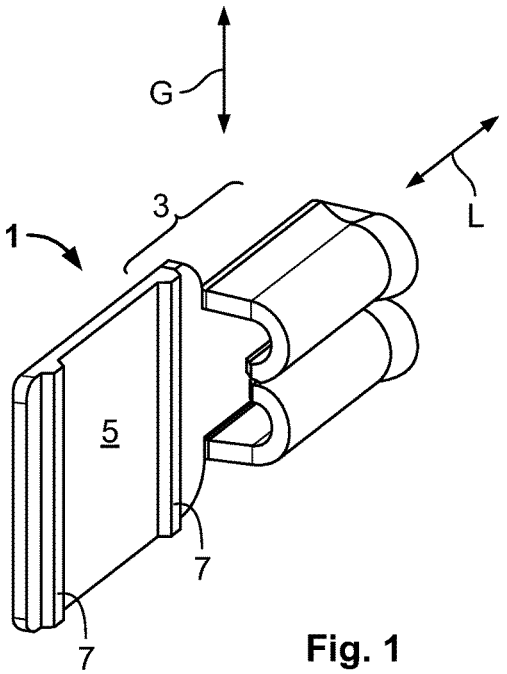
FIG. 1 shows a preferred embodiment of a blade connector according to the invention in a perspective view.
Figure 2:
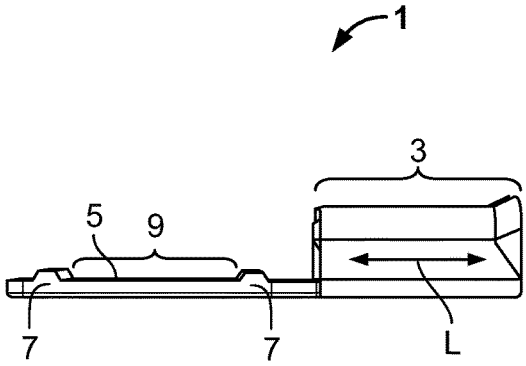
FIG. 2 shows the blade connector of FIG. 1 in a side view along the guiding direction.

In the area 9 of the contact surface plane 5, which is arranged between the two guiding elements 7, the blade connector 1 may be provided with at least one contacting protrusion 13 (not shown in FIGS. 1 and 2 but shown in other figures). For example, the area 9 may be provided with monolithically integrated solid structures, such as pyramids or ripples, which protrude away from the contact surface plane 5. The blade connector 1 may also be provided with monolithically integrated elastically deflectable contacting protrusions which extend away from the contact surface plane 5 and are elastically deflectable towards the same.

Figure 3:
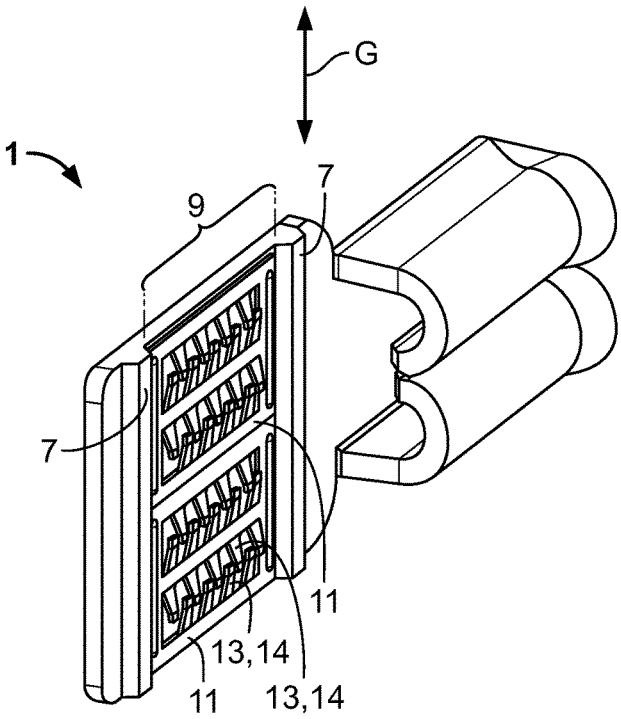
FIG. 3 shows the blade connector of FIG. 1 with two contacting plates in a perspective view.
Figure 4:
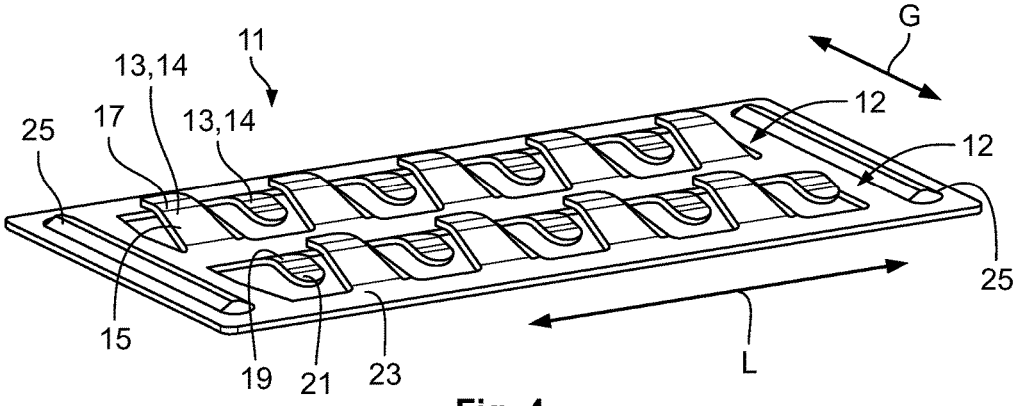
FIG. 4 shows one contacting plate of FIG. 3 in a perspective view.
Figure 5:
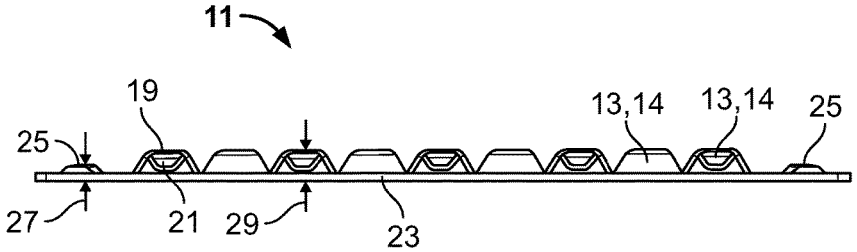
FIG. 5 shows the contacting plate of FIG. 4 in a side view.

As shown in FIGS. 3 to 5, in a preferred embodiment of a blade connector 1 according to the invention, a plurality of contacting protrusions 13 are arranged on contacting plates 11. The blade connector 1 shown in FIGS. 3 to 5 is identical to the one as shown in FIGS. 1 and 2 except for the inclusion of the contacting plates 11 in FIGS. 3 to 5. Between the guiding elements 7 (i.e., in the area 9, the blade connector 1 is provided with two contacting plates 11. Each contacting plate 11 has a plurality of contacting protrusions 13 which are elastically deflectable. In particular, the elastically deflectable contacting protrusions 13 are leaf springs 14. By way of example, the blade connector 1 is shown with two contacting plates 11. The contacting protrusions 13 may also be provided on a single contacting plate 11 or on a plurality of contacting plates 11. In the case that the blade connector 1 is provided with two contacting plates 11, the contacting plates 11 may abut each other in the guiding direction G to provide an effective covering of at least the area 9 of the contact surface plane 5.

The contacting plates 11 are positioned on and conductively connected to the contact surface plane 5. In a preferred embodiment, the contacting plates 11 are connected to the contact surface plane 5 by laser welding. However, other suitable methods for electrically and mechanically connecting the contacting plates 11 to the contact surface plane 5 may be used. By way of example, the contacting plates 11 may be connected to the contact surface plane 5 by soldering, ultrasonic welding or riveting.

A contacting plate 11 is now described in closer detail with respect to FIGS. 4 and 5. The contacting plate 11 may have an overall rectangular shape and comprise two rows 12 of contacting protrusions 13. The rows 12 extend parallel with the longitudinal direction L and are arranged next to each other in the guiding direction G.

The contacting protrusions 13 are preferably formed as leaf springs 14 which are monolithically formed with the contacting plate 11. Each contacting protrusion 13 is connected via a base 15 with the contacting plate 11 and comprises a free end 17 with which the contacting protrusion 13 extends away from the contacting plate 11. Each contacting protrusion 13 preferably extends basically parallel with the guiding direction G.

Preferably, the contacting protrusions 13 of one row 12 are arranged in an alternating manner with each contacting protrusion 13 pointing with its free end 17 in a direction opposite to a direction of an adjacent contact protrusion 13. In this case, an adjacent contacting protrusion 13 refers to a neighboring contacting protrusion 13 in the same row 12.

At the free end 17, each contacting protrusion 13 may have a bent section 19, in which a tip 21 of the contacting protrusion 13 is bent back towards the contacting plate 11. The bent section 19 protects the contacting protrusion 13 from being torn away from the contacting plate 11 when a second connector is moved along the blade connector 1 in the guiding direction G. The contacting protrusions 13 are elastically deflectable towards the contact surface plane 5 or, in other words, to a body 23 of the contacting plate 11.

In order to prevent over-bending of the contacting protrusions 13 by a second connector and, as a result thereof, plastic deformation of the contacting protrusions 13, the contacting plate 11 is preferably provided with spacers 25. As an example, the contacting plate 11 is shown in FIGS. 4 and 5 with two spacers 25. The spacers 25 are non-deflectable or at least less elastic than the leaf springs 14. The spacers 25 space a second connector from the contact surface plane 5 such that the contacting protrusions 13 can only be deflected as long as the spacers 25 do not prevent a further movement of a second connector towards the contact surface plane 5. This is achieved in that the spacers 25 define a distance 27 from the contact surface plane 5, which is smaller than a protruding length 29 with which the contacting protrusions 13 protrude away from the contact surface plane 5 perpendicular to the longitudinal direction L and to the guiding direction G in a non-deflected state. This is shown in FIGS. 3 to 5. The spacers 25 preferably extend along the guiding direction G. According to a preferred embodiment, the spacers 25 are spaced apart from each other with the two rows 12 of contacting protrusions 13 between them.

In the following, a preferred embodiment of a second connector 31, according to the invention, is described with respect to FIGS. 6 and 7. The second connector 31 may be a blade connector or another flat connector. By way of example, the second connector 31 is shown with an angular mounting section 33 with a through-hole 35. The second connector 31 may also be provided with a crimp section or any other suitable mounting section 33.

The second connector comprises two complementarily guiding elements 37 which are formed complementary to the guiding elements 7 of the blade connector 1. The complementary guiding elements 37 extend along a guiding direction G which is identical to the guiding direction G of the blade connector 1 when the second connector 31 is mated with the blade connector 1. The complementary guiding elements 37 taper into a contact surface plane 5 of the second connector 31 and each have a trapezoidal cross-sectional shape perpendicular to the guiding direction G. Each complementary guiding element 37 has the overall shape of a groove longitudinally extending along the guiding direction G.

The complementary guiding elements 37 are spaced apart from each other in a direction perpendicular to the guiding direction G which extends along the longitudinal direction L of the blade connector 1 in the mated state. The contact surface plane 5 between the two complementary guiding elements 37 is preferably smooth and undisturbed. However, this is just exemplarily. The contact surface plane 5 may also be provided with at least one contacting protrusion 13. Especially in the case that the blade connector 1 is formed without a contacting protrusion 13, the second connector 31 may be provided with at least one such contacting protrusion 13.

In the following, a first advantageous embodiment of a mounting cage 39 is described with respect to FIGS. 8 and 9. The mounting cage 39 is preferably formed as a stamp-bent part and has an overall shape of a box. The mounting cage 39 comprises a first receiving section 41 for the blade connector 1 and a second receiving section 43 for the second connector 31. The first receiving section 41 is accessible through a blade opening 45. Preferably, a side of the mounting cage 39, which lies opposite to the blade opening 45, is closed by an entrance preventing wall 47. Preferably, the first receiving section 41 extends continuously from the blade opening 45 to the entrance preventing wall 47. The entrance preventing wall 47 extends preferably perpendicular to the longitudinal direction L of the blade connector 1.

On two opposing sides 49 which oppose each other in the guiding direction G, the mounting cage 39 is provided with two locking members 51 which protrude into the mounting cage 39 and which separate the first receiving section 41 from the second receiving section 43. The locking members 51 are adapted to positively lock a blade connector 1 which is inserted in the first receiving section 41 against a movement towards the second receiving section 43. The locking members 51 are monolithically formed with the mounting cage 39.

On each of the sides 49, the mounting cage 39 is provided with an insertion opening 53 for the second connector 31. However, the mounting cage 39 may also be provided with a single insertion opening 53. If the mounting cage 39 has two insertion openings 53 which are arranged opposite to each other in the guiding direction G, then the mounting cage 39 may be used for two different insertion directions of a second connector 31.

The mounting cage 39 has a clamping device 55 which is preferably formed monolithically with the mounting cage 39. The clamping device 55 is preferably arranged such that the second receiving section 43 is between the clamping device 55 and the first receiving section 41. By this, the clamping device 55 may exert pressure on the second connector 31 towards the blade connector 1 in the mated state. The clamping device 55 may be adapted with respect to its mechanical properties only because the electrical contact between the blade connector 1 and the second connector 31 will be established by the direct contact between these items and especially by the contact surface planes 5 of the connectors 1 and 31.

When no second connector 31 is inserted in the mounting cage 39, the clamping device 55 preferably protrudes into the second receiving section 43. Upon insertion of the second connector 31 into the second receiving section 43, the clamping device 55 is elastically deflected away from the second receiving section 43 and exerts a pressure on the second connector 31.

In order to provide a stable and compact mounting cage 39 and to allow the insertion of the second connector 31 from two different directions perpendicular to the guiding direction G, the clamping device 55 is shaped as a leaf spring which is connected to the mounting cage 39 at two opposing ends 57. Therefore, the clamping device 55 does not have a free end which may be damaged when a second connector 31 is pushed against the free end during insertion into the second receiving section 43. However, this does not exclude the possibility of providing the mounting cage 39 with a leaf spring with a free end. In this case, the mounting cage 39 would preferably be provided with a single insertion opening 53 for the second connector 31 in such the insertion direction for the second connector 31 is identical to a direction in which the free end of the leaf spring extends.

Preferably, the clamping device 55 protrudes from the boundary 59 of a clamping device opening 61 into the mounting cage 39. The clamping device opening 61 is continuously surrounded by material 63 from which the mounting cage 39 is formed. The clamping device opening 61 is preferably arranged in a wall 65 which is arranged adjacent to the second receiving section 43.

The mounting cage 39 may further be provided with a guiding wall 67 which extends from the wall 65 in the direction of the blade opening 45. The guiding wall 67 extends basically along the guiding direction G and parallel with the entrance preventing wall 47. During insertion of a second connector 31, the second connector 31 may be guided between the guiding wall 67 and the entrance preventing wall 47.

Figure 8:
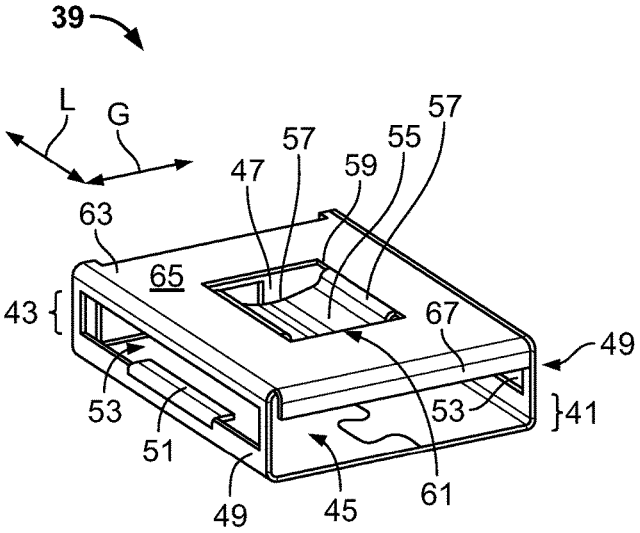
FIG. 8 shows a first embodiment of a mounting cage according to the invention in a perspective view.
Figure 9:
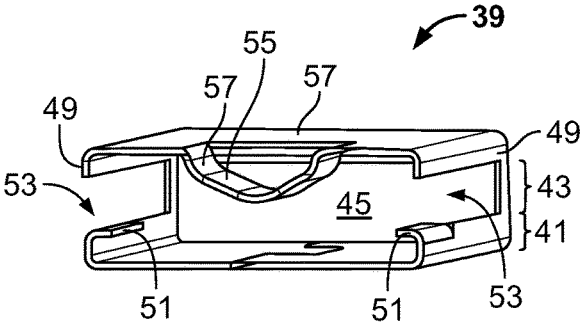
FIG. 9 shows a cutout of the mounting cage of FIG. 8 in a perspective view.
Figure 10:
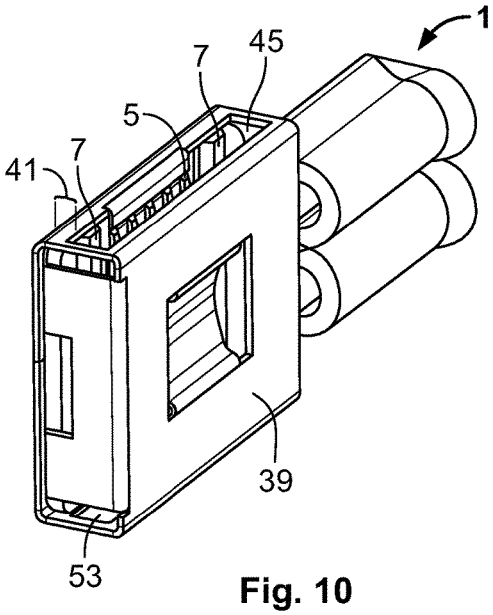
FIG. 10 shows the blade connector of FIG. 3 in a mounting cage of FIG. 8 in a perspective view.

FIG. 10 shows a blade connector 1 as shown in FIG. 3 in a mounting cage 39 which is shown in FIGS. 8 and 9. The contact surface plane 5 of the blade connector 1 is completely received in the mounting cage 39. The locking members 51 are bent around the blade connector 1 such that the mounting cage 39 is captively held around the blade connector 1. As a result, each locking member 51 is at least partially arranged between the contact surface plane 5 of the blade connector 1 and the second receiving section 43. On the contact surface plane 5 of the blade connector 1, each locking member 51 is at least partially arranged between the guiding elements 7.

With the blade connector 1 being inserted in the first receiving section 41 through the blade opening 45, the mounting cage 39 is basically closed, except for the two insertion openings 53 for the second connector 31. The term "closed" refers to being closed for objects of the size of the blade connector 1 or the second connector 31.

Figure 11:
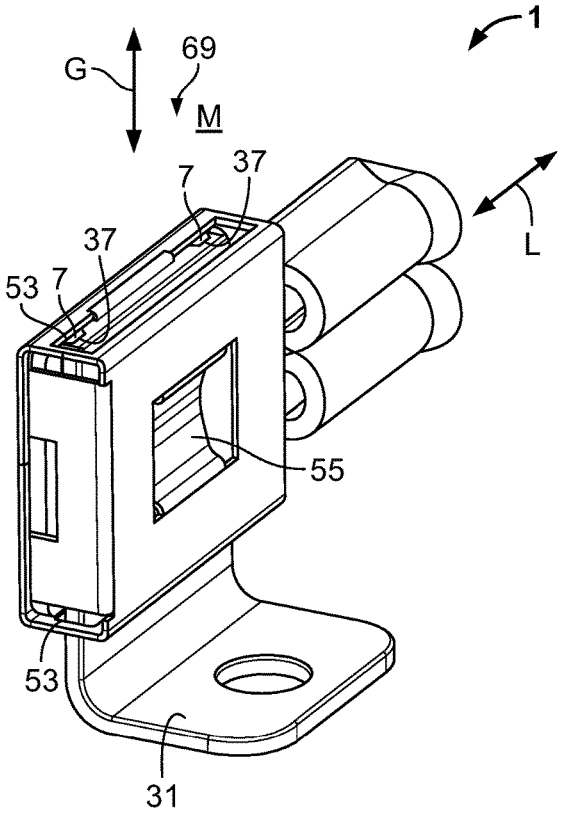
FIG. 11 shows a first embodiment of an assembly according to the invention with the blade connector of FIG. 3 with the second connector of FIG. 6 inside the mounting cage of FIG. 8 in a mated state in a perspective view.
Figure 12:
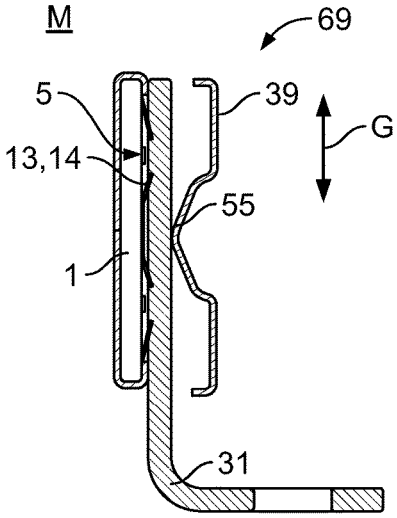
FIG. 12 shows the assembly of FIG. 11 in a cross-sectional view perpendicular to the longitudinal direction.
Figure 13:
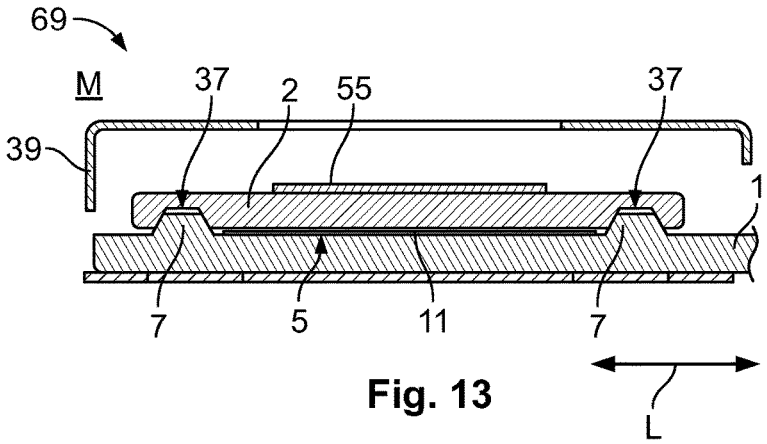
FIG. 13 shows the assembly of FIG. 11 in a cross-sectional view perpendicular to the guiding direction.

In the following, the mated state M of a blade connector 1 and a second connector 31 which are mated inside a mounting cage 39, according to the invention, is described with respect to FIGS. 11 to 13. The blade connector 1, the second connector 31 and the mounting cage 39 are identical to the elements as described with respect to FIGS. 3 to 10.

The blade connector 1, the second connector 31 and the mounting cage 39 together form an advantageous embodiment of an assembly 69 according to the invention. It should be noted that an assembly 69 may also be formed by only a blade connector 1 according to the invention and only a second connector 31 according to the invention.

In the mated state M, the second connector 31 is inserted in the second receiving section 43. The guiding elements 7 of the blade connector 1 are seated in the complementary guiding elements 37 of the second connector 31. The clamping device 55 exerts pressure on the second connector 31 in the direction towards the contact surface plane 5 of the blade connector 1. The second connector 31 elastically deflects the contacting protrusions 13 so that the contacting protrusions exert a counter pressure towards the second connector 31. As a result, the second connector 31 is electrically connected to the blade connector 1. In the mated state, the assembly 69 effectively secures the relative position of the second connector 31 to the blade connector 1, at least along the longitudinal direction L.

For reaching the mated state M, the blade connector 1 captively held within the mounting cage 39 can be moved along the guiding direction G onto the second connector 31. The second connector 31 may be fixed to another element (not shown). During movement of the blade connector 1, the second connector 31 may penetrate through one of the insertion openings 53 into the second receiving section 43. As a result, the blade connector 1 and the second connector 31 may be mutually guided along each other by the interaction of the guiding elements 7 and the complementary guiding elements 37.

Figure 14:
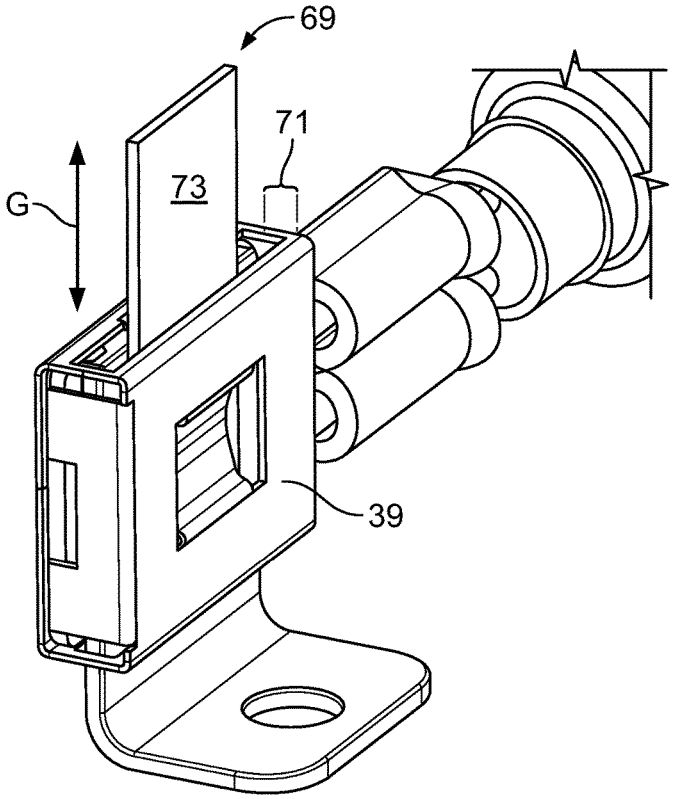
FIG. 14 shows a second embodiment of an assembly according to the invention with the blade connector of FIG. 3 with the second connector of FIG. 6 inside a second embodiment of a mounting cage according to the invention in a mated state in a perspective view.
Figure 15:
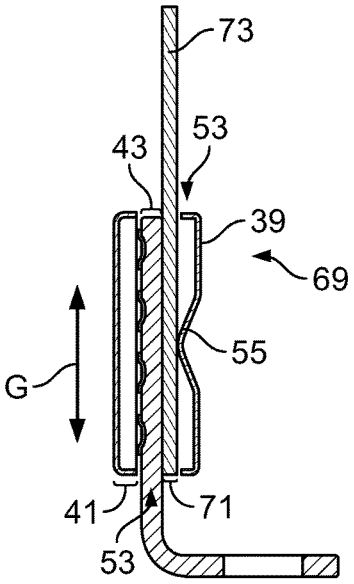
FIG. 15 shows the embodiment of FIG. 14 in a cross-sectional view perpendicular to the longitudinal direction.

FIGS. 14 and 15 show a second embodiment of an assembly 69 according to the invention. For the sake of clarity, only the differences with respect to the previously shown embodiment of the assembly 69 are described.

The mounting cage 39 comprises a receptacle 71 for a clamping plate 73. The receptacle 71 may be formed as an extension of the second receptacle 43 in the direction of the clamping device 55. This can be achieved by a clamping device 55 which does not protrude towards the first receptacle receiving section 41 as far as the clamping device 55 of the first embodiment, in case the overall shape and size of the mounting cage 39 of the second embodiment is to be similar to the mounting cage 39 of the first embodiment. The receptacle 71 allows for mating the second connector 31 with the blade connector 1 with zero insertion force. The receptacle 71 extends the second receiving section 43 such that a second connector 31 may be inserted into the second receiving section 43 without being pressed against the blade connector 1 by the clamping device 55. Only after the second connector 31 is inserted in the second receiving section 43, is the clamping plate 73 inserted into the receptacle 71 to transmit the pressure from the clamping device 55 onto the second connector 31. For facilitating the insertion of the clamping plate 73, the clamping plate 73 may be inserted through an insertion opening 53 of the mounting cage 39 which is arranged opposite to the insertion opening 53 through which the second connector 31 was inserted.

What is claimed is:

1. A connector assembly for electrically contacting a blade connector to a second connector, the connector assembly comprising:

a blade connector, extending in a longitudinal direction, having:

(a) a contact surface plane, and (b) at least one guiding element on the contact surface plane of the blade connector and extending along a guiding direction basically perpendicular to the longitudinal direction along which the blade connector extends;

a second connector electrically connected to the blade connector in a mated state through the contact surface plane; and a mounting cage captively holding the blade connector and having at least one clamping device that presses the second connector onto the contact surface plane of the blade connector in the mated state.

2. The connector assembly according to claim 1, wherein the at least one guiding element is at least one of a rail, a rib, and a series of spot-like structures.

3. The connector assembly according to claim 2, wherein, the at least one guiding element has an overall trapezoidal cross-sectional shape perpendicular to the guiding direction of the guiding element.

4. The connector assembly according to claim 3, wherein the at least one guiding element protrudes from the contact surface plane perpendicular to the longitudinal direction along which the blade connector extends and the guiding direction along which the guiding element extends.

5. The connector assembly according to claim 4:

(a) further including a contacting plate positioned on and conductively connected to the contact surface plane of the blade connector, and (b) wherein, the contact surface plane has a plurality of contacting protrusions monolithically integrated with a contacting plate.

6. The connector assembly according to claim 4, wherein the contact surface plane has at least one contacting protrusion which protrudes away from the contact surface plane perpendicular to the longitudinal direction along which the blade connector extends.

7. The connector assembly according to claim 6, wherein the at least one contacting protrusion is between two guiding elements which are spaced apart from each other along the longitudinal direction along which the blade connector extends.

8. The connector assembly according to claim 7, wherein the at least one contacting protrusion is elastically deflectable.

9. The connector assembly according to claim 8 the at least one contacting protrusion is a leaf spring.

10. The connector assembly according to claim 5, further including a second connector electrically connected to the contact surface plane of the blade connector in a mated state and having at least one complementary guiding element which is formed complementary to the at least one guiding element of the blade connector.

11. The connector assembly according to claim 10, wherein in the mated state, the at least one guiding element of the blade connector and the at least one complementary guiding element are positively locked in the longitudinal direction along which the blade connector extends.

12. The connector assembly according to claim 11, wherein the contact surface plane of the blade connector has at least one elastically deflectable contacting protrusion and at least one non-deflectable spacer that separate the second connector from the contact surface plane of the blade connector by a distance which is smaller than a protruding length of the at least one contacting protrusion.

13. The connector assembly according to claim 12:

(a) further including at least one clamping plate, and (b) wherein the mounting cage has a receptacle in which the at least one clamping plate is positioned.

14. The connector assembly according to claim 13, wherein the mounting cage has a receptacle for the at least one clamping plate between the blade connector and the at least one clamping device in the mated state.

15. A connector assembly for electrically contacting a blade connector to a second connector, the connector assembly comprising:

a blade connector, extending in a longitudinal direction, having:

(a) a contact surface plane, and (b) at least one guiding element on the contact surface plane of the blade connector:

(1) extending along a guiding direction basically perpendicular to the longitudinal direction along which the blade connector extends, and (2) is at least one of a rail, a rib, and a series of spot-like structures, (3) has an overall trapezoidal cross-sectional shape perpendicular to the guiding direction of the guiding element, and (4) protrudes from the contact surface plane perpendicular to the longitudinal direction along which the blade connector extends and the guiding direction along which the guiding element extends, and a second connector electrically connected to the blade connector in a mated state through the contact surface plane; and a mounting cage captively holding the blade connector and having at least one clamping device that presses the second connector onto the contact surface plane of the blade connector in the mated state.

* * * * *